US010861260B2

(12) United States Patent
Stacy

(10) Patent No.: US 10,861,260 B2
(45) Date of Patent: Dec. 8, 2020

(54) DRIVING BEHAVIOUR MONITORING SYSTEMS

(71) Applicant: Wunelli Limited, Hampshire (GB)

(72) Inventor: Paul Rowan Stacy, Hampshire (GB)

(73) Assignee: Wunelli Limited, Hampshire (GB)

( * ) Notice: Subject to any disclaimer, the term of this patent is extended or adjusted under 35 U.S.C. 154(b) by 156 days.

(21) Appl. No.: 16/129,490

(22) Filed: Sep. 12, 2018

(65) Prior Publication Data

US 2019/0026965 A1 Jan. 24, 2019

Related U.S. Application Data

(63) Continuation of application No. 14/568,568, filed on Dec. 12, 2014, now Pat. No. 10,089,799.

(30) Foreign Application Priority Data

Dec. 12, 2013 (GB) ..... 1322030.6

(51) Int. Cl.
*G08G 1/123* (2006.01)
*G07C 5/08* (2006.01)

(52) U.S. Cl.
CPC ..... *G07C 5/0841* (2013.01); *G07C 5/0808* (2013.01)

(58) Field of Classification Search
None
See application file for complete search history.

(56) References Cited

U.S. PATENT DOCUMENTS

2005/0208925 A1* 9/2005 Panasik ..... H04M 1/72538 455/404.1
2011/0279263 A1* 11/2011 Rodkey ..... G08B 25/016 340/539.13
2013/0069802 A1* 3/2013 Foghel ..... G08G 1/205 340/989

FOREIGN PATENT DOCUMENTS

GB 2485971 6/2012

OTHER PUBLICATIONS

Search Report issued by the UK Intellectual Property Office dated May 22, 2014 in corresponding UK Application No. GB1322030.6.

* cited by examiner

*Primary Examiner* — Adam D Tissot
(74) *Attorney, Agent, or Firm* — Troutman Pepper Hamilton Sanders LLP; James E. Schutz; Mark Lehi Jones

(57) ABSTRACT

A driving behaviour monitoring device having a data processor and a geographic positioning module in which the processor will make a determination, based on monitored driving behaviour, whether a vehicle is likely to have been involved in an accident, and record a geographical location associated with the data, and to further determine whether the device has changed its geographical position by more than a predetermined distance within a predetermined time. Driving data collected may also be used to calculate or adjust insurance premiums and/or to provide safety feedback.

17 Claims, 2 Drawing Sheets

DRIVING BEHAVIOUR MONITORING SYSTEMS

CROSS REFERENCE TO RELATED APPLICATION

This application is a Continuation of U.S. patent application Ser. No. 14/568,568 entitled "Driving Behaviour Monitoring Systems," filed 12 Dec. 2014, and published as U.S. Patent Application Publication No. US2015/0170436 on 18 Jun. 2015, the contents of which are incorporated by reference in their entirety as if fully set forth herein.

TECHNICAL FIELD

The present invention relates generally to driving behaviour monitoring systems.

BACKGROUND

It can be desirable to monitor how a vehicle is used in order to be able to use the vehicle usage data for a supplementary purpose. One use of such vehicle usage data is to be able to calculate, or adjust, a vehicle insurance premium in dependence upon how the vehicle is being used. Another use of such vehicle usage data would be to provide feedback to the driver on how they are driving, for example, how safely they are driving. We seek to provide improvements in relation to such systems.

We have appreciated that when a genuine driving accident occurs, the driver is more likely to stay within a certain distance of the vehicle (or incident or impact scene) within a certain period of time. We have devised a driving behaviour monitoring system which can determine the likelihood of a genuine driving accident.

SUMMARY

According to a first aspect of the invention there is provided a data processor, the data processor arranged to communicate with a driving behaviour monitoring device, the data processor arranged to receive and process driving behaviour data from the device including the instantaneous geographical location of the device, based on the received driving behaviour data, the data processor arranged to determine whether a vehicle, which carries the device, receives driving behaviour data which is indicative of a driving accident event, and if such an event is determined, the data processor arranged to record the geographical location associated with the event, and the data processor further arranged to determine whether the geographical location of the device has changed by more than a predetermined distance from the event location, within a predetermined amount of time.

The data processor may be termed a driving behaviour monitoring data processor.

The device may be viewed as collecting, processing and transmitting (to the data processor) driving behaviour data.

The data processor may be arranged to communicate with the device by way of a telecommunications network. The data processor may be part of a server mode.

The data processor may be arranged to determine when a sequence or combined sequence of detected events, or one of a plurality of specified events, occurs, which sequence or event is predetermined as being indicative of a potential accident. For example, such a predetermined sequence of events may include a sudden or extremely abrupt deceleration (derived from geographical positioning data), followed by an engine OFF signal (as received in a signal from the vehicles engine control unit) and the vehicle being determined to be stationary. Broadly, the data processor stores data against which real-time vehicle usage data is compared to determine if a driving accident event has occurred.

A memory of the data processor preferably stores a plurality of potential accident event sequences.

Once a (potential) accident event has been determined, the data processor is preferably then operative to store the geographical position of the (stationary) vehicle, and then determine whether the geographical position of the device exceeds the (potential accident) location by more than a predetermined amount, within a predetermined time.

Preferably the device arranged to receive a plurality of data input sources which are used to perform driving monitoring.

Preferably the device is arranged to receive data inputs including at least one of the following:

Vehicle operating data

Vehicle speed

Acceleration (including deceleration)

The device is preferably arranged to monitor for a predetermined deceleration range, which can be used, at least in part, to identify a potential accident event.

According to an alternative aspect of the invention there is provided a driving behaviour monitoring device, which comprises a data processor, the device further comprising a geographic positioning module and the processor may be arranged to determine, if sensed driving behaviour data which is indicative of a driving accident event and to record a geographical location associated with the data and to further determine whether the device has changed its geographical position by more than a predetermined distance within a predetermined time. In the alternative embodiment, the device may be arranged to process received input data which relate to real-time characteristics of the vehicle and is dynamics, so as to determine (as opposed to the data processor remote of the device) whether a potential accident event has occurred.

Preferably, when the monitoring functionality is activated, positional data of the vehicle, or data derived from the positional data, may be recorded and/or output by the device.

The device may comprise an installed software application which is operative to implement driving monitoring functionality.

The geographic positioning module is preferably arranged to communicate with a satellite positioning system, such as GPS, for example.

The device may comprise a cellular mobile telecommunications device or telephone.

The device may be enabled to determine the speed and/or acceleration of the vehicle.

The device may be arranged to determine the presence of a short range air interface communications device installed in the vehicle. The device may be arranged to detect a polling signal emitted by the communications device. The communications device may be a Bluetooth® device, for example.

The data processor may be arranged to measure changes in acceleration experienced by the device. The data processor may determine sequences of changes in acceleration experienced by the device, and compares the sequences to stored patterns of acceleration. The data processor is preferably arranged to determine whether there is sufficient similarity between the measured acceleration sequence and the stored acceleration pattern and if it is determined that there is a sufficient similarity which is indicative of a driving accident event.

According to another aspect of the invention there is provided a driving behavior monitoring system which comprises a data processor server and a driving behaviour monitor device, the server arranged to receive driving behaviour data from the device and determine if an accident event has occurred and to evaluate the same by determining whether the device has been displaced by more that a predetermined amount in an predetermined time.

The device may be arranged to communicate with an onboard diagnostics module or engine management unit of the vehicle and to obtain vehicle usage or operational data therefrom. The onboard diagnostics module may be arranged to transmit vehicle ignition-on and vehicle ignition-off events and data from the vehicle's management system. The device may be arranged to use said data in determining whether a driving accident event has occurred.

According to a further aspect of the invention there is provided a method of operating a driving behaviour monitor, the method may comprise using driving behaviour data sensed by the device to determine whether a driving accident event has occurred.

The method may comprise using data sensed by the device within the local environment of the device, to determine if said device is in the frame of reference of a vehicle.

A further aspect of the invention relates to machine-readable instructions arranged, when executed by a data processor, to implement the auto-start functionality of the first aspect of the invention. The instructions may be realised as a software product. The software product may be suitable for installation onto a telecommunications device.

The invention may be viewed as an incident alert filtering system.

The above aspects of the invention may include any of the features described in the detailed description and/or drawings.

BRIEF DESCRIPTION OF THE DRAWINGS

Various embodiments of the invention will now be described, by way of example only, with reference to the accompanying drawings in which.

DETAILED DESCRIPTION

Figure 1:
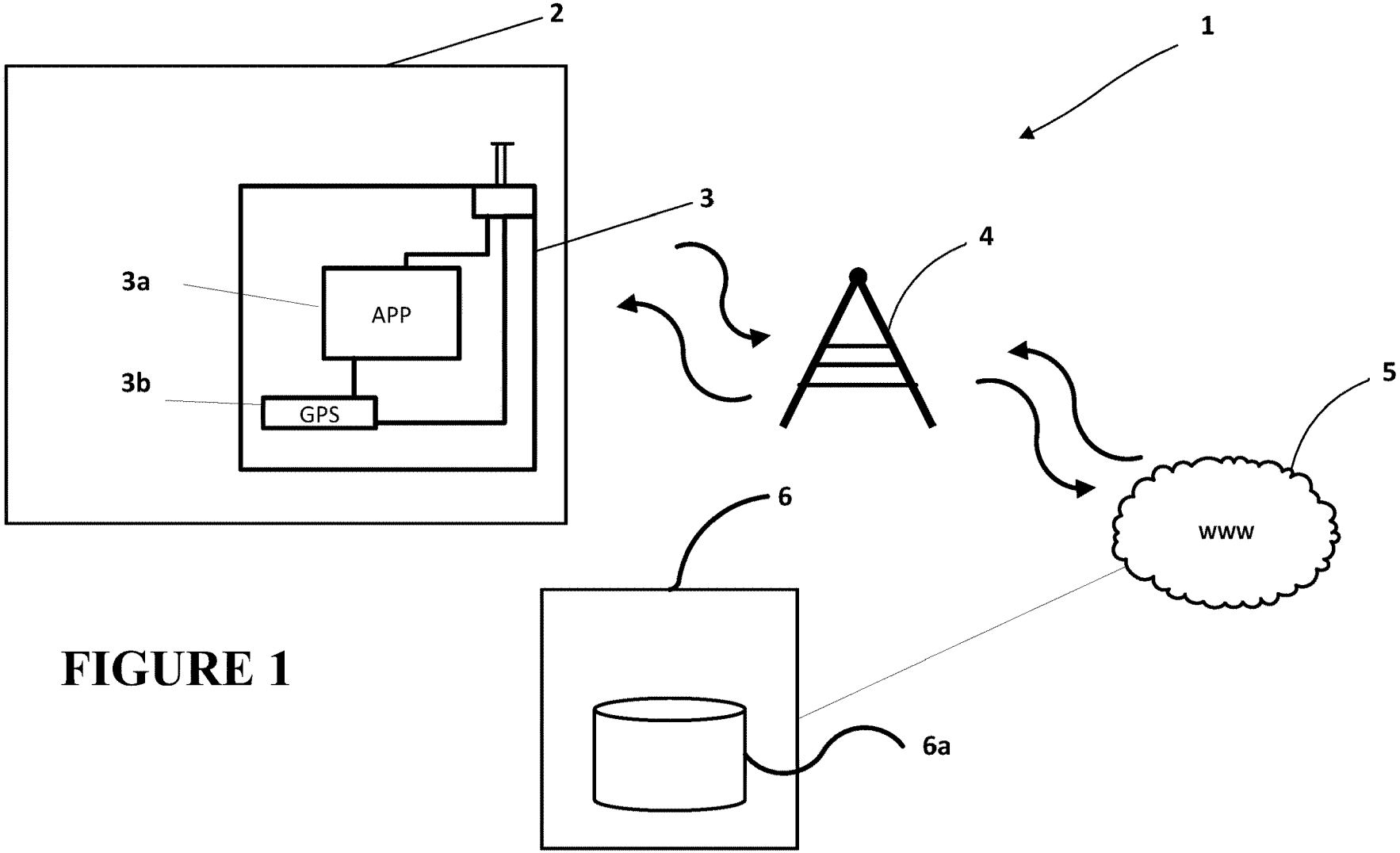
FIG. 1 is a schematic diagram of a driving behaviour monitoring system.

Reference is made initially to FIG. 1 which shows a driving behaviour monitoring system 1, which comprises a cellular mobile communications device 3, and a driving behaviour server 6. Broadly, the telephone 3 is provided with an application 3*a* which is operative, when executed by a data processor of the telephone, to monitor the driving behaviour of the user of the telephone whilst driving a vehicle 2. The application 3*a* receives driving behaviour data indicative of the driver's speed, acceleration, geographical position via a navigational positional module 3*b*, such as Global Positioning System (GPS). The application also receives data from the vehicle 2, such as the vehicle's on board diagnostics module, which generates vehicle usage data. The telephone is operative to send the data, via a telecommunications network, 4 and 5, to a server 6, where the data is processed to determine a driving behaviour score and (as described below) to determine and evaluate driving accident events. Driving scores are caused to be stored in a database 6*a*.

In use, the data processor 6 receives driving behaviour data from the device 3, by way of the telecommunications network. The data received by the device 3 includes geographic positional data (by way of communication with a satellite array), (vehicle) speed, (vehicle) acceleration, vehicle operating data (by way of data received from the vehicle's diagnostic module, which the device is arranged to communicate with).

The memory 6*a* of the data processor 6 stores data which is characteristic of a (potential) driving accident having occurred in relation to received driving behaviour data from the monitor device, and to determine whether received data correlates sufficiently to the stored data to be indicative of a (potential) driving accident. This could include a sudden deceleration and an engine OFF signal from the diagnostic module. Having recognised that an accident event has occurred, the data processor 6 stores a geographic location which is associated with the accident event data ie the accident event data arose at a particular geographic location with the triggering data being deducible from timestamp data applied to the device on sending the data to the data processor.

Figure 2:
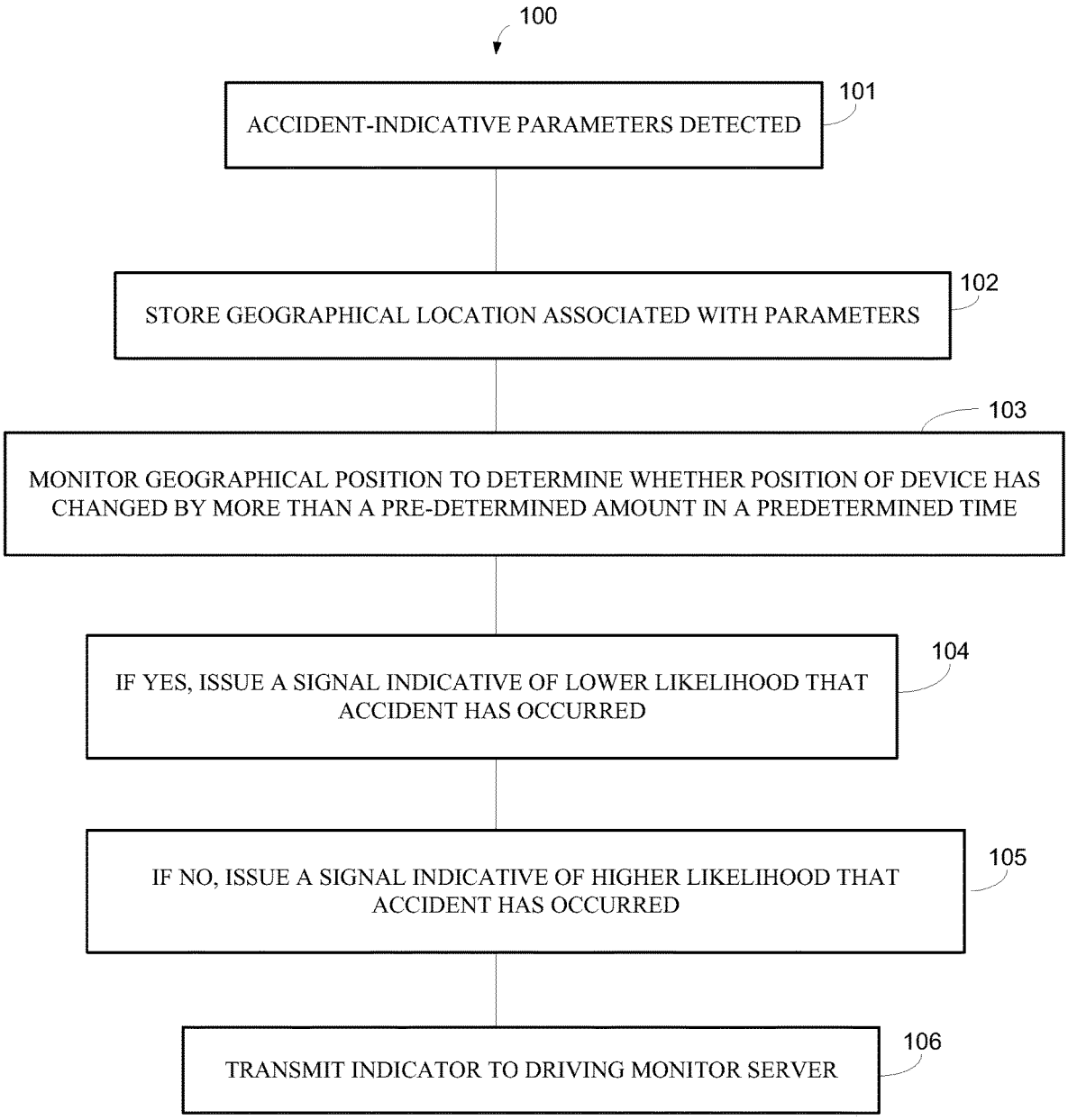
FIG. 2 is a flow diagram of a first sequence of processing steps performed by the device to determine if a driving accident event has occurred.

Having now determined that an accident event has occurred, and having stored the geographic location, the processor now implements a routine which serves to determine whether it is more or less likely that the accident event does instead relate to an actual traffic accident, such as a collision. The processor now commences a timer which is operational for a predetermined period. During that period the processor receives, periodically, updates of geographic position data of the device 6. If, during the predetermined time, the processor determines that the device 6 has moved further away from the accident event location by more than a predetermined distance, the processor determines that it is less likely that an actual accident has occurred. If, however, the device does not exceed that predetermined distance in the given time, it is more likely that an actual traffic accident has occurred, in the latter case, the data processor records on the memory details of the time and location of the accident. However, it may be that the driver has simply had to make an emergency stop and the engine stalled, with no injury to the driver, or any damage to the user's vehicle or a third party's vehicle or property. The process which is conducted by the processor is shown in FIG. 2 which shows a flow diagram with steps 101 to 106.

The above process is of particular advantage in being able to provide a meaningful indication to an insurance provider of the user, as to the likelihood of an accident having occurred. This information may be used by the insurance provider to adjust the user's premium and/or to challenge the veracity of a false insurance claim for a fraudulent claim of a (non-existent) accident. The apparatus described above may be viewed as an incident alert filtering system with the capacity to filter out events that are unlikely to be actual/genuine accident alerts.

What is claimed is:

1. A method, comprising:

receiving, from a vehicle diagnostics module, driving behavior data comprising deceleration data;

responsive to determining that the deceleration data is within a predetermined deceleration range:

storing an initial geographical location of a mobile communications device;

storing one or more subsequent geographical locations of the mobile communications device, each of the one or more subsequent geographical locations time stamped with time data;

receiving, from the vehicle diagnostics module, an indication of an ignition state;

determining, based on a comparison of the stored initial geographical location and the one or more stored subsequent geographical locations, a change in geographical position of the mobile communications device and whether the change in position exceeds a predetermined distance and within a predetermined period;

determining that a driving accident has likely occurred based at least in part on the change in geographical position not exceeding the predetermined distance within the predetermined period and an engine OFF indication is received within the predetermined period; and transmitting an indication of a driving accident to a driving monitor server.

2. The method of claim 1, further comprising:

determining that a driving accident has likely not occurred when the change in geographical position exceeds the predetermined distance within the predetermined period; and transmitting an indication of no driving accident to a driving monitor server.

3. The method of claim 1, wherein determining that a driving accident has likely occurred further comprises determining that a predetermined sequence detected events has occurred.

4. The method of claim 1, wherein receiving the driving behavior data comprises receiving deceleration data indicative of a deceleration sequence, and wherein determining that a driving accident has likely occurred is further based on determining a correlation between the deceleration sequence and a stored deceleration pattern.

5. The method of claim 1, further comprising determining whether the mobile communications device is in a frame of reference of a vehicle.

6. The method of claim 5, wherein the determining is based on data sensed by the mobile communications device.

7. The method of claim 1, wherein a timer is started responsive to the determined deceleration being within the predetermined deceleration range.

8. The method of claim 1, further comprising:

receiving, by the vehicle diagnostics module, driving behavior data comprising acceleration data;

responsive to determining that the acceleration data is within a predetermined acceleration range:

determining a speed of the mobile communications device; and further determining that a driving accident has likely occurred based at least in part on the speed not exceeding a predetermined value within the predetermined period.

9. A system comprising:

a mobile communications device comprising:

one or more processors;

memory in communication with the one or more processors;

instructions stored in the memory that, when executed by the one or more processors, cause the mobile communications device to:

receive driving behavior data comprising deceleration data;

responsive to determining that the deceleration data is within a predetermined deceleration range:

store an initial geographical location;

store one or more subsequent geographical locations, each of the one or more subsequent geographical locations time stamped with time data;

receive an indication of an ignition state;

determine, based on a comparison of the stored initial geographical location and the one or more stored subsequent geographical locations, a change in geographical position of the mobile communications device and whether the change in position exceeds a predetermined distance and within a predetermined period;

determine that a driving accident has likely occurred based at least in part on the change in geographical position not exceeding the predetermined distance within the predetermined period and an engine OFF indication is received within the predetermined period; and transmit an indication of a driving accident to a driving monitor server.

10. The system of claim 9, wherein the instructions further cause the mobile communications device to determine that a driving accident has likely not occurred when the change in geographical position exceeds the predetermined distance within the predetermined period.

11. The system of claim 9, wherein the instructions further cause the mobile communications device to determine that a driving accident has likely occurred when a predetermined sequence detected events has been detected.

12. The system of claim 9, wherein the driving behavior data comprises deceleration data indicative of a deceleration sequence, and wherein determining that a driving accident has likely occurred is further based on determining a correlation between the deceleration sequence and a stored deceleration pattern.

13. The system of claim 9, wherein the instructions further cause the mobile communications device to determine whether the mobile communications device is in a frame of reference of a vehicle.

14. The system of claim 9, wherein a timer is started responsive to the determined deceleration being within the predetermined deceleration range.

15. The system of claim 9, wherein the instructions further cause the mobile communications device to:

receive driving behavior data comprising acceleration data;

responsive to determining that the acceleration is within a predetermined acceleration range:

determining a speed of the mobile communications device; and further determine that a driving accident has likely occurred based at least in part on the speed not exceeding a predetermined value within the predetermined period.

16. A non-transitory computer readable storage medium storing instructions for use with a machine vision system, wherein the instructions are configured to cause the system to perform a method comprising:

receiving, from a vehicle diagnostics module, driving behavior data comprising deceleration data;

responsive to determining that the deceleration data is within a predetermined deceleration range:

storing an initial geographical location of a mobile communications device;

storing one or more subsequent geographical locations of the mobile communications device, each of the one or more subsequent geographical locations time stamped with time data;

receiving, from the vehicle diagnostics module, an indication of an ignition state;

determining, based on a comparison of the stored initial geographical location and the one or more stored subsequent geographical locations, a change in geographical position of the mobile communications device and whether the change in position exceeds a predetermined distance and within a predetermined period;

determining that a driving accident has likely occurred based at least in part on the change in geographical position not exceeding the predetermined distance within the predetermined period and an engine OFF indication is received within the predetermined period within the predetermined period; and transmitting an indication of a driving accident to a driving monitor server.

17. The non-transitory computer readable storage medium of claim 16, further comprising:

determining that a driving accident has likely not occurred when the change in geographical position exceeds the predetermined distance within the predetermined period; and transmitting an indication of no driving accident to a driving monitor server.

* * * * *